US005924967A

United States Patent [19]

Furlani et al.

[11] Patent Number: 5,924,967

[45] Date of Patent: Jul. 20, 1999

[54] WEAR RESISTANT TRANSPORT ROLLER

[75] Inventors: Edward P. Furlani, Lancaster; Syamal K. Ghosh; Dilip K. Chatterjee, both of Rochester, all of N.Y.

[73] Assignee: Eastman Kodak Company, Rochester, N.Y.

[21] Appl. No.: 08/901,184

[22] Filed: Jul. 28, 1997

[51] Int. Cl.[6] ..... B30B 3/04

[52] U.S. Cl. ..... 492/54; 492/56

[58] Field of Search ..... 492/54, 56

[56] References Cited

U.S. PATENT DOCUMENTS

| | | | |
|---|---|---|---|
| 3,942,230 | 3/1976 | Nalband . | |
| 4,078,285 | 3/1978 | Seanor | 492/54 |
| 4,643,095 | 2/1987 | Pfizenmaier et al. . | |
| 4,704,776 | 11/1987 | Watanabe et al. | 492/54 |
| 4,862,799 | 9/1989 | Hyener et al. | 492/54 |
| 4,977,656 | 12/1990 | Lioy et al. . | |
| 5,240,666 | 8/1993 | Schnyder et al. . | |
| 5,283,121 | 2/1994 | Bordner | 492/54 |
| 5,411,462 | 5/1995 | Link | 492/54 |
| 5,474,821 | 12/1995 | Kass | 492/56 |
| 5,547,450 | 8/1996 | Matsumoto et al. | 492/54 |
| 5,548,897 | 8/1996 | Link | 492/54 |
| 5,553,381 | 9/1996 | Lehtonen | 492/56 |
| 5,629,061 | 5/1997 | Kass | 492/56 |
| 5,632,861 | 5/1997 | Crouse | 492/54 |

FOREIGN PATENT DOCUMENTS

| | | |
|---|---|---|
| 0 499 656 A1 | 2/1991 | European Pat. Off. . |
| 0 553 429 A1 | 11/1992 | European Pat. Off. . |

*Primary Examiner*—Irene Cuda
*Assistant Examiner*—Trinh T. Nguyen
*Attorney, Agent, or Firm*—Clyde E. Bailey, Sr.

[57] ABSTRACT

A transport roller having a core and a first bonding layer at least partially surrounding and bonded to the core. Further, roller has a first layer of corrosion material at least partially surrounding and bonded to the first bonding layer, wherein said corrosion resistant material is electroplated nickel or electroless nickel. In addition, the roller has a second bonding layer for bonding a second layer to the core. The second layer includes a wear and abrasion resistant material, wherein the wear and abrasion resistant material is selected from the group including polyurethane; acrylic; silicon dioxide; alumina; chromium oxide; zirconium oxide; composites of zirconia-alumina; or a mixture thereof.

2 Claims, 2 Drawing Sheets

WEAR RESISTANT TRANSPORT ROLLER

FIELD OF THE INVENTION

The invention relates to transport rollers, more particularly, the invention concerns wear resistant transport rollers for transporting webs of material in corrosive environments.

BACKGROUND OF THE INVENTION

Material transport systems utilizing transport rollers are used extensively in manufacturing processes to transport components from one station to the next. In numerous manufacturing processes, the transport system is exposed to abrasive or corrosive environments. For example, in electroplating, painting and encapsulation of components, pretreatment processes such as cleaning, and surface etching entail the exposure of the transport system and transported components to abrasive particles and corrosive chemicals. Conventional transport rollers degrade when exposed to corrosive or abrasive environments. The degradation of the transport rollers, in turn, causes premature degradation of the web due to their mutual contact during the transport process. Thus, material transport systems utilizing conventional rollers used in corrosive or abrasive environments require costly and time consuming maintenance for roller repair and replacement. Therefore, a need exists for transport rollers that can operate without degradation in corrosive or abrasive environments. The subject of this disclosure is a wear, abrasion and corrosion resistant transport roller for web transport in abrasive and corrosive manufacturing environments.

SUMMARY OF THE INVENTION

It is, therefore, one object of the invention to provide a transport roller that is capable of transporting a web in a corrosive environment.

It is another object of the invention to provide a transport roller that is wear and abrasion resistant.

It is a feature of the invention that a transport roller, in rotating contact with a web, has multiple layers including a corrosion resistant layer and a wear and abrasion resistant layer surrounding a core.

To solve one or more of the problems above, there is provided a transport roller having a core, and a first bonding layer at least partially surrounding and bonded to the core. Further, the transport roller has a first layer of corrosion resistant material at least partially surrounding and bonded to the first bonding layer, wherein said first corrosion resistant material is electroplated nickel or electroless nickel. Further, there is a second bonding layer for bonding a second layer to the core. The second layer comprises a wear and abrasion resistant material, wherein said wear and abrasion resistant material is selected from the group consisting of: polyurethane; acrylic; silicon dioxide; alumina; chromium oxide; zirconium oxide; composites of zirconia-alumina; or a mixture thereof.

It is therefore an advantageous effect of the present invention that materials can transported in a corrosive environment without degradation of the transport web.

BRIEF DESCRIPTION OF THE DRAWINGS

The above mentioned and other objects, features and advantages of the invention and the manner of attaining them will become more apparent and the invention itself will be better understood by reference to the following description of an embodiment of the invention taken in conjunction with the accompanying drawings, wherein.

DETAILED DESCRIPTION OF THE INVENTION

Figure 1A:
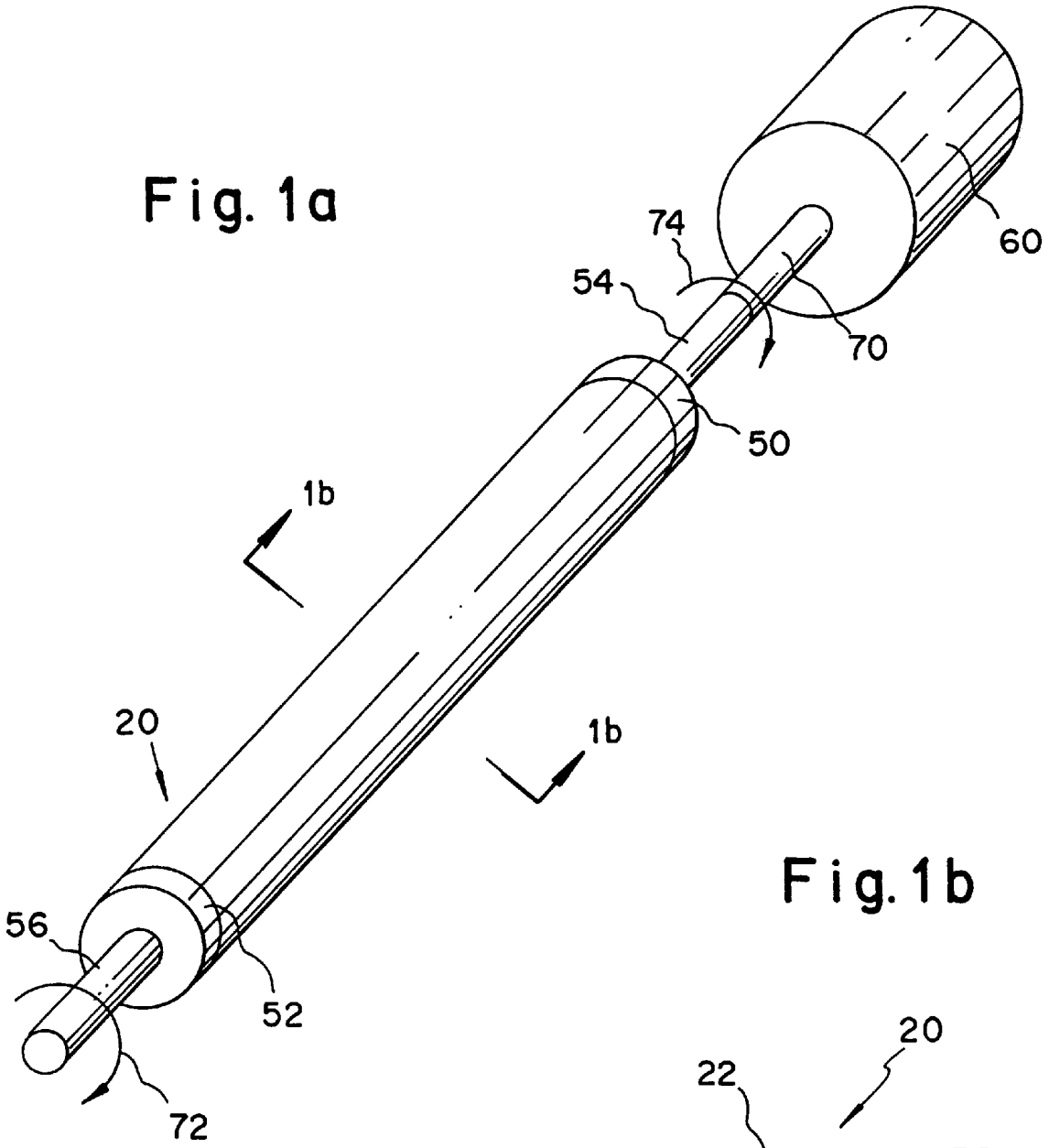
FIG. 1*a* is a perspective view of a transport roller with an attached motor drive.

Referring to FIG. 1*a,* a perspective is shown of the transport roller 20 with end support members 50 and 52 with shaft portions 54 and 56, respectively, which are shrunk fit onto the ends of rollers 20, and a motor 60 with rotor shaft 70. The shaft portion 52 of end support member 50 is fixedly attached to rotor shaft 70 of motor 60. The roller 20 is free to rotate about its longitudinal axis, and when motor 60 rotates it causes rotation of roller 20 as indicated by rotation arrows 72 and 74. The end support members 50 and 52 are made from AISI 316 stainless steel, wherein the shaft portions 54 and 56 are electroplated with Teflon impregnated nickel so as to reduce the coefficient of friction.

Figure 1B:
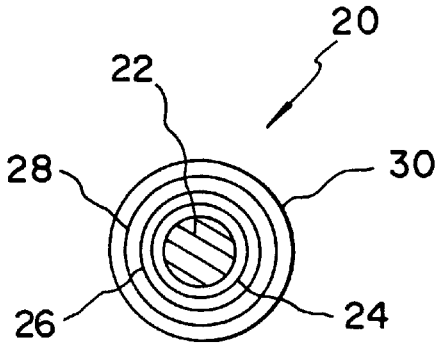
FIG. 1*b* is a cross-sectional view taken along line 1*a*—1*a* of FIG. 1*a;*

Referring to FIG. 1*b,* the roller 20 is shown in a cross-sectional view of FIG. 1*a.* Roller 20 comprises a core 22. In addition to core 22, roller 20 comprises first and second layers 26 and 30 surrounding the core 22. Layers 26 and 30 are preferably coated onto the core 22 using the techniques described below. According to our preferred embodiment, a first bonding layer 24 is coated onto the core 22. First bonding layer 24 is preferably comprised of copper or copper based alloys, chromium, gold, silver and combinations thereof. Most preferred is copper and its alloys. Skilled artisans will appreciate that bonding layer 24 may be applied to core 22 by using any of several conventional techniques. We, however, prefer depositing the first bonding layer 24 onto core 22 using physical vapor deposition (PVD), chemical vapor deposition (CVD), or some electroless or electrolytic deposition process, each producing substantially the same result. Preferably, we deposit first bonding layer 24 onto core 22 using an electrolytic deposition process. In the preferred embodiment, first bonding layer 24 has a thickness in the range of about 50 to 200 Angstroms, preferably 100 Angstroms.

Referring once again to FIG. 1*b,* after the first bonding layer 24 is bonded to core 22, a first layer 26 comprising a corrosion resistant material, is coated onto the first bonding layer 24. First layer 26 comprises preferably a coating of electroplated nickel or electroless nickel. The preferred method for depositing the first layer 26 of corrosion resistant material onto first bonding layer 24 is electroless plating. The first bonding layer 24 functions to enhance the adhesion of the first layer 26 of corrosion resistant material to the core 22. Preferably, first layer 26 has a thickness between 0.1 mil to 1 mil, most preferred being 0.5 mil.

According to FIG. 1*b,* a second bonding layer 28 is coated onto first layer 26. Second bonding layer comprises alloys of nickel-aluminum, nickel-chromium, cobalt-chromium-aluminum or combinations thereof. While numerous techniques may be used to deposit the second bonding layer 28, we prefer using PVD or plasma spraying. Preferably, second bonding layer 28 has a thickness in the range of about 1,000 to 10,000 Angstroms, most preferred being 5,000 Angstroms.

Still referring to FIG. 1*b,* a second layer 30 comprising a wear and abrasion resistant material, is coated onto the second bonding layer 28. The second bonding layer 28 enhances the adhesion and minimizes the porosity of the second layer 30 by sealing pores (not shown) in the second layer 30. The preferred method for coating the second layer 30 onto the second bonding layer 28 is by dipping the roller 20 in solutions of polyurethane or acrylic. Alternatively, the second layer 30 may be spin or dip coated onto the second bonding layer 28 of roller 20 in a solution of sol-gel comprising silicon dioxide or alumina. Yet another acceptable technique for coating the second layer 30 onto the second bonding layer 28 is by thermal or plasma spraying with a wear and abrasion resistant material such as chromium oxide, zirconium oxide, or composites of zirconia-alumina.

Figure 2:
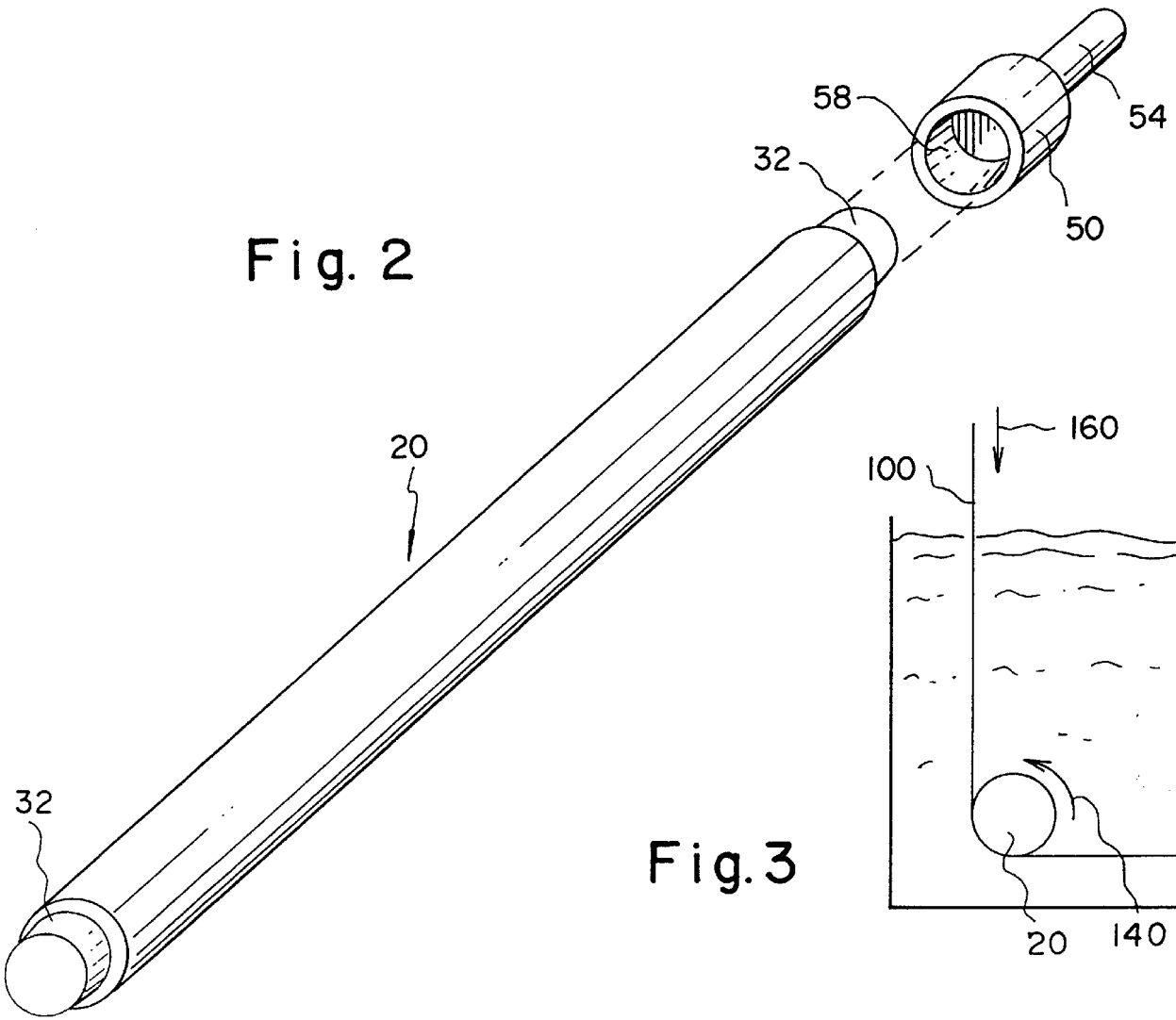
FIG. 2 is perspective view of the magnetic roller and end shaft member of the invention; and, FIG. 3 is a schematic view of a web transport system utilizing the transport roller of the present invention.

Referring to FIG. 2, a perspective view is shown of the roller 20 having similarly tapered ends 32 and an end support member 50 mounted on either of the tapered ends 32. End support member 50 has an opening 58 for receiving the tapered end 32 of roller 20. Preferably, end support member 50 is fixedly attached to a tapered end 32 of roller 20 by shrink fitting or alternatively by press fitting.

Figure 3:
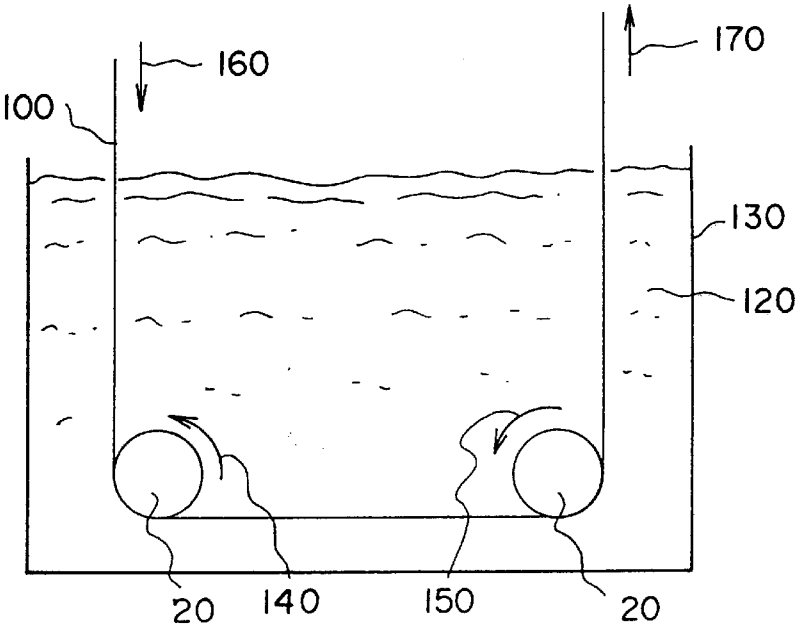

Referring to FIG. 3, a schematic view of a web transport system utilizing the transport roller 20 is shown. A web of material 100 is transported through a corrosive solution 120 in container 130. A pair of transport rollers 20 rotate as indicated by rotation arrows 140 and 150 and move and guide the web as indicated by the arrows 160 and 170.

While the invention has been described with a certain degree of particularity, it is manifest that many changes may be made in the details of the construction and the arrangement of the components without departing from the spirit and scope of the disclosure. It is understood that the invention is not limited to the embodiments set forth herein for purposes of exemplification, but is to be limited only by the scope of the attached claims, including the full range of equivalency to which each element thereof is entitled.

PARTS LIST

10 . . . transport roller assembly
20 . . . roller
22 . . . core
24 . . . first bonding layer
26 . . . first layer
28 . . . second bonding layer
30 . . . second layer
32 . . . tapered end
50 . . . end support member
52 . . . end support member
54 . . . shaft portion
56 . . . shaft portion
58 . . . opening
60 . . . motor
70 . . . rotor shaft
72 . . . rotation arrow
74 . . . rotation arrow
100 . . . web
120 . . . corrosive solution
130 . . . container
140 . . . rotation arrow
150 . . . rotation arrow
160 . . . arrow
170 . . . arrow

What is claimed is:

1. A transport roller, comprising a core;

first bonding layer at least partially surrounding and bonded to said core;

a first layer of corrosion resistant material at least partially surrounding and bonded to said first bonding layer, wherein said corrosion resistant material is electroplated nickel or electroless nickel;

a second bonding layer at least partially surrounding and bonded to said first layer, said first bonding layer being selected from the group consisting of: (a) copper; (b) copper based alloys; (c) chromium; (d) gold; (e) silver; and (f) a mixture thereof; and, a second layer at least partially surrounding and bonded to said second bonding layer, said second layer comprising a wear and abrasion resistant material, wherein said wear and abrasion resistant material is selected from the group consisting of: (a) polyurethane; (b) acrylic; (c) silicon dioxide; (d) alumina; (e) chromium oxide; (f) zirconium oxide; (g) composites of zirconia-alumina; or a mixture thereof.

2. The transport roller recited in claim 1, wherein said first bonding layer is selected from the group consisting of: (a) copper; (b) copper based alloys; (c) chromium; (d) gold; (e) silver; and (f) a mixture thereof.

* * * * *

UNITED STATES PATENT AND TRADEMARK OFFICE

CERTIFICATE OF CORRECTION

PATENT NO. : 5,924,967
DATED : July 20, 1999
INVENTOR(S) : Edward P. Furlani, et. al.

It is certified that error appears in the above-identified patent and that said Letters Patent is hereby corrected as shown below:

Column 2, Line 5,
after "line" delete "1a-1a" and insert --1b-1b--.

Column 2, Line 19,
after "portion" and before "of" delete "52" and insert --54--.

Column 3, Parts List,
delete "10...transport roller assembly".

Column 4, Claim 1, Line 32,
at the beginning of the line and before "(f) a mixture thereof" delete "and" and insert --or--.

Signed and Sealed this
Seventh Day of March, 2000

*Attest:*

*Attesting Officer*

Q. TODD DICKINSON

*Commissioner of Patents and Trademarks*